US009229390B2

(12) United States Patent
Egi et al.

(10) Patent No.: US 9,229,390 B2
(45) Date of Patent: Jan. 5, 2016

(54) FIXING DEVICE AND IMAGE FORMING APPARATUS

(71) Applicant: KYOCERA Document Solutions Inc., Osaka (JP)

(72) Inventors: Makoto Egi, Osaka (JP); Yasuhito Okajima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/309,064

(22) Filed: Jun. 19, 2014

(65) Prior Publication Data

US 2014/0376935 A1 Dec. 25, 2014

(30) Foreign Application Priority Data

Jun. 20, 2013 (JP) ..... 2013-129458

(51) Int. Cl.
*G03G 15/20* (2006.01)
*G03G 15/00* (2006.01)

(52) U.S. Cl.
CPC ..... *G03G 15/2053* (2013.01); *G03G 15/55* (2013.01); *G03G 15/205* (2013.01); *G03G 2215/2035* (2013.01)

(58) Field of Classification Search
CPC ..... G03G 15/2017; G03G 15/505; G03G 15/5054; G03G 15/70; G03G 2215/2045
See application file for complete search history.

(56) References Cited

U.S. PATENT DOCUMENTS 6,014,539 A * 1/2000 Sano ..... G03G 15/2053 219/216
8,099,007 B2 * 1/2012 Tsueda ..... G03G 15/2064 399/320
2008/0131166 A1 * 6/2008 Yokoyama ..... G03G 17/00 399/159
2010/0266307 A1 * 10/2010 Kagawa ..... G03G 15/2035 399/70
2011/0229161 A1 9/2011 Ueno et al.

(Continued)

FOREIGN PATENT DOCUMENTS

JP 2003-316181 A 11/2003
JP 2005-249958 A 9/2005

(Continued)

OTHER PUBLICATIONS

An Office Action; "Notice of Reasons for Rejection," issued by the Japanese Patent Office on Sep. 15, 2015, which corresponds to Japanese Patent Application No. 2013-129458 and is related to U.S. Appl. No. 14/309,064.

*Primary Examiner* — Clayton E Laballe
*Assistant Examiner* — Victor Verbitsky
(74) *Attorney, Agent, or Firm* — Studebaker & Brackett PC

(57) ABSTRACT

A fixing device includes a fixing belt, a pressuring rotation body, a drive transmission member, a detected member, and a rotation detecting part. The fixing belt rotates around a rotation axis. The pressuring rotation body comes into pressure contact with the fixing belt to form a fixing nip. The drive transmission member is held by one end part of the fixing belt. The detected member is held by another end part of the fixing belt. The rotation detecting part detects the rotation of the detected member. The fixing belt is configured to co-rotate with the rotation of the drive transmission member by friction force between the one end part of the fixing belt and drive transmission member. The detected member is configured to co-rotate with the rotation of the fixing belt by friction force between the other end part of the fixing belt and detected member.

10 Claims, 8 Drawing Sheets

(56) References Cited

U.S. PATENT DOCUMENTS

| | | | | |
|---|---|---|---|---|
| 2012/0070201 | A1* | 3/2012 | Shiobara | G03G 15/0131 399/302 |
| 2012/0263509 | A1* | 10/2012 | Yokoyama | G03G 15/2053 399/329 |
| 2013/0195491 | A1* | 8/2013 | Suzuki | G03G 15/2046 399/69 |

FOREIGN PATENT DOCUMENTS

| | | | | |
|---|---|---|---|---|
| JP | 2006162659 | A | * | 6/2006 |
| JP | 2008-176285 | A | | 7/2008 |
| JP | 2009217057 | A | * | 9/2009 |
| JP | 2011-002710 | A | | 1/2011 |
| JP | 2011-191590 | A | | 9/2011 |

* cited by examiner

FIXING DEVICE AND IMAGE FORMING APPARATUS

INCORPORATION BY REFERENCE

This application is based on and claims the benefit of priority from Japanese Patent application No. 2013-129458 filed on Jun. 20, 2013, the entire contents of which are incorporated herein by reference.

BACKGROUND

The present disclosure relates to a fixing device fixing a toner image on a recording medium and an image forming apparatus including the fixing device.

An electrographic image forming apparatus, such as a printer or a copying machine, forms a toner image on a surface of a recording medium, such as a sheet, and then, heats and pressures the recording medium and toner image by a fixing device, thereby fixing the toner image on the recording medium.

As a manner applied in the above-mentioned fixing device, a manner forming a fixing nip heating and pressuring the recording medium and toner image by a fixing roller and a pressuring roller is known. The above-mentioned fixing roller is formed, for example, by covering the outer circumference face of a cored bar made of metal by a resin having high toner releasability. As a heat source heating the above-mentioned fixing roller, for example, a halogen heater is used. The halogen heater is arranged, for example, inside the cored bar of the fixing roller.

On the other hand, another manner (so-called as an "IH (Induction Heating) manner") using an IH coil as the heat source instead of the halogen heater is known. The above-mentioned IH coil produces magnetic field by conducting electricity. In such an IH manner-type fixing device, instead of forming the fixing nip by the fixing roller and pressuring roller, the fixing nip is often formed by a fixing belt and the pressuring roller. The above-mentioned fixing belt is made of a rotatable endless belt. The magnetic field produced by the above-mentioned IH coil acts on the fixing belt so as to produce eddy current, thereby generating heat in the fixing belt.

As a rotating manner of the fixing belt, a manner rotating the fixing belt together with one or more rollers arranged at an internal diameter side of the fixing belt is known. On the other hand, another manner sliding the fixing belt with respect to a pressuring member arranged at the internal diameter side of the fixing belt is also known.

In the fixing device with such a manner, since temperature rising rate of the fixing belt is high, if the fixing belt is heated in a stopping state, there is a possibility that the temperature of a part of the fixing belt is excessively risen and the excessive risen part receives damage. Then, in the above-mentioned fixing device, secure rotation of the fixing belt and detection of the rotation of the fixing belt are important tasks.

As a measure to securely rotate the fixing belt, there is a configuration gluing and fixing a drive transmission member to an end part of the fixing belt, the drive transmission member transmitting the assistive drive to the fixing belt.

As a measure to detect the rotation of the fixing belt, there is a configuration attaching a bias stopping ring to the end part of the fixing belt and detecting rotation of rotation detection blade by a sensor, the rotation detection blade being connected to the bias stopping ring. In such a technique, by meshing a tooth-like shape arranged in the end part of the fixing belt with a tooth-like shape arranged in the outer circumference part of the bias stopping ring, the bias stopping ring is co-rotated with the rotation of the fixing belt.

However, in the configuration gluing and fixing the drive transmission member to the end part of the fixing belt, the end part of the fixing belt is corrected in a roughly precise round shape by the drive transmission member. Therefore, a shape (an imprecise round shape) of a periphery part of the fixing nip of the fixing belt and a shape (a roughly precise round shape) of the end part of the fixing belt are different from each other, and accordingly, there is a possibility that great stress is added to the fixing belt to break down the fixing belt.

In the configuration attaching the bias stopping ring to the end part of the fixing belt, it is necessary to arrange the respective tooth-like shape to the end part of the fixing belt and the outer circumference part of the bias stopping ring in order to co-rotate the bias stopping ring with the rotation of the fixing belt, and accordingly, there is a possibility complicating manufacturing process of the fixing device.

Moreover, in the fixing device using the fixing belt, after the end part of the fixing belt is broken for some reason, a situation of continuously rotating the fixing belt may be caused. With regard to such a point, in the fixing device, the break of the end part of the fixing belt is often detected by a temperature sensor. However, in such a configuration, there is a possibility that the break of the end part of the fixing belt cannot be detected depending on position relationship between an occurrence location of the break and the temperature sensor.

SUMMARY

In accordance with an embodiment of the present disclosure, a fixing device includes a fixing belt, a pressuring rotation body, a drive transmission member, a detected member, and a rotation detecting part. The fixing belt rotates around a rotation axis. The pressuring rotation body comes into pressure contact with the fixing belt to form a fixing nip. The drive transmission member is held by one end part of the fixing belt. The detected member is held by another end part of the fixing belt. The rotation detecting part detects the rotation of the detected member. The fixing belt is configured to co-rotate with the rotation of the drive transmission member by friction force between the one end part of the fixing belt and drive transmission member. The detected member is configured to co-rotate with the rotation of the fixing belt by friction force between the other end part of the fixing belt and detected member.

In accordance with an embodiment of the present disclosure, an image forming apparatus includes a fixing device. The fixing device includes a fixing belt, a pressuring rotation body, a drive transmission member, a detected member, and a rotation detecting part. The fixing belt rotates around a rotation axis. The pressuring rotation body comes into pressure contact with the fixing belt to form a fixing nip. The drive transmission member is held by one end part of the fixing belt. The detected member is held by another end part of the fixing belt. The rotation detecting part detects the rotation of the detected member. The fixing belt is configured to co-rotate with the rotation of the drive transmission member by friction force between the one end part of the fixing belt and drive transmission member. The detected member is configured to co-rotate with the rotation of the fixing belt by friction force between the other end part of the fixing belt and detected member.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
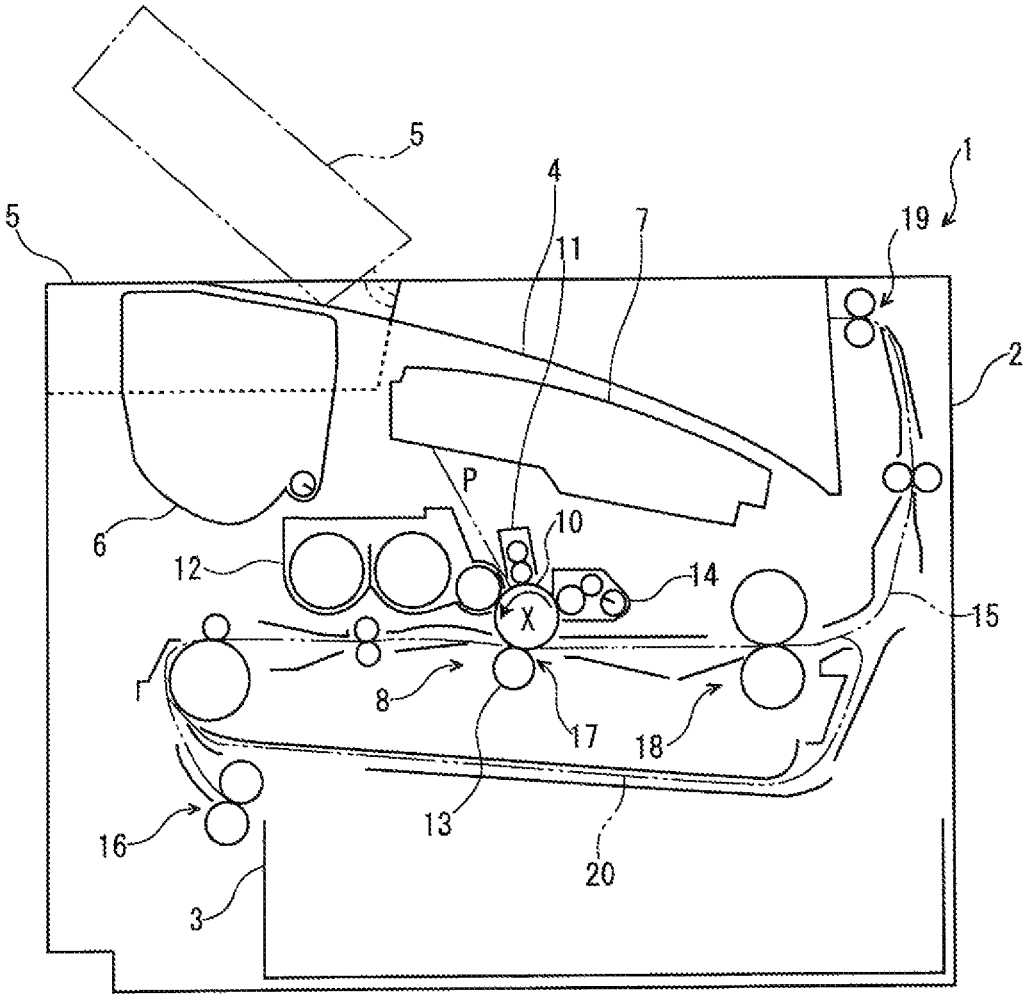
FIG. 1 is a schematic diagram schematically showing a printer according to an embodiment of the present disclosure.

First, with reference to FIG. 1, the entire structure of a printer 1 (an image forming apparatus) will be described.

The printer 1 includes a box-like formed printer main body 2. In a lower part of the printer main body 2, a sheet feeding cartridge 3 storing sheets (recording mediums) is installed and, in a top face of the printer main body 2, a sheet ejected tray 4 is formed. To top face of the printer main body 2, an upper cover 5 is openably/closably attached at the side of the sheet ejected tray 4 and, below the upper cover 5, a toner container 6 is installed.

In an upper part of the printer main body 2, an exposure device 7 composed of a laser scanning unit (LSU) is located below the sheet ejected tray 4. Below the exposure device 7, an image forming part 8 is arranged. In the image forming part 8, a photosensitive drum 10 as an image carrier is rotatably arranged. Around the photosensitive drum 10, a charger 11, a development device 12, a transfer roller 13 and a cleaning device 14 are located along a rotating direction (refer to an arrow X in FIG. 1) of the photosensitive drum 10.

Inside the printer main body 2, a conveying path 15 for the sheet is arranged. At an upstream end in the conveying path 15, a sheet feeder 16 is positioned. At an intermediate stream part in the conveying path 15, a transferring part 17 composed of the photosensitive drum 10 and transfer roller 13 is positioned. At a downstream part in the conveying path 15, a fixing device 18 is positioned. At a downstream end in the conveying path 15, a sheet ejecting part 19 is positioned. Below the conveying path 15, an inversion path 20 for duplex printing is arranged.

Next, the operation of forming an image by the printer 1 having such a configuration will be described.

When the power is supplied to the printer 1, various parameters are initialized and initial determination, such as temperature determination of the fixing device 18, is carried out. Subsequently, in the printer 1, when image data is inputted and a printing start is directed from a computer or the like connected with the printer 1, image forming operation is carried out as follows.

First, the surface of the photosensitive drum 10 is electric-charged by the charger 11. Then, exposure corresponding to the image data on the photosensitive drum 10 is carried out by a laser light (refer to a two-dot chain line P in FIG. 1) from the exposure device 7, thereby forming an electrostatic latent image on the surface of the photosensitive drum 10. Subsequently, the development device 12 develops the electrostatic latent image by a toner (a developer).

On the other hand, a sheet fed from the sheet feeding cartridge 3 by the sheet feeder 16 is conveyed to the transferring part 17 in a suitable timing for the above-mentioned image forming operation, and then, the toner image carried on the photosensitive drum 10 is transferred onto the sheet in the transferring part 17. The sheet with the transferred toner image is conveyed to a downstream side in the conveying path 15 to go forward to the fixing device 18, and then, the toner image is fixed on the sheet in the fixing device 18. The sheet with the fixed toner image is ejected from the sheet ejecting part 19 to the sheet ejected tray 4. The toner remained on the photosensitive drum 10 is collected by the cleaning device 14.

Next, the fixing device 18 will be described in detail with reference to FIGS. 2-7.

Hereinafter, it will be described so that the front side of the fixing device 18 is positioned at the near side of FIG. 2, for convenience of explanation. Arrows Fr in FIGS. 3, 4 and 6 indicate the front side of fixing device 18. Arrows I in FIGS. 4 and 6 indicate inside in forward and backward directions and arrows O in FIGS. 4 and 6 indicate outside in the forward and backward directions.

Figure 2:
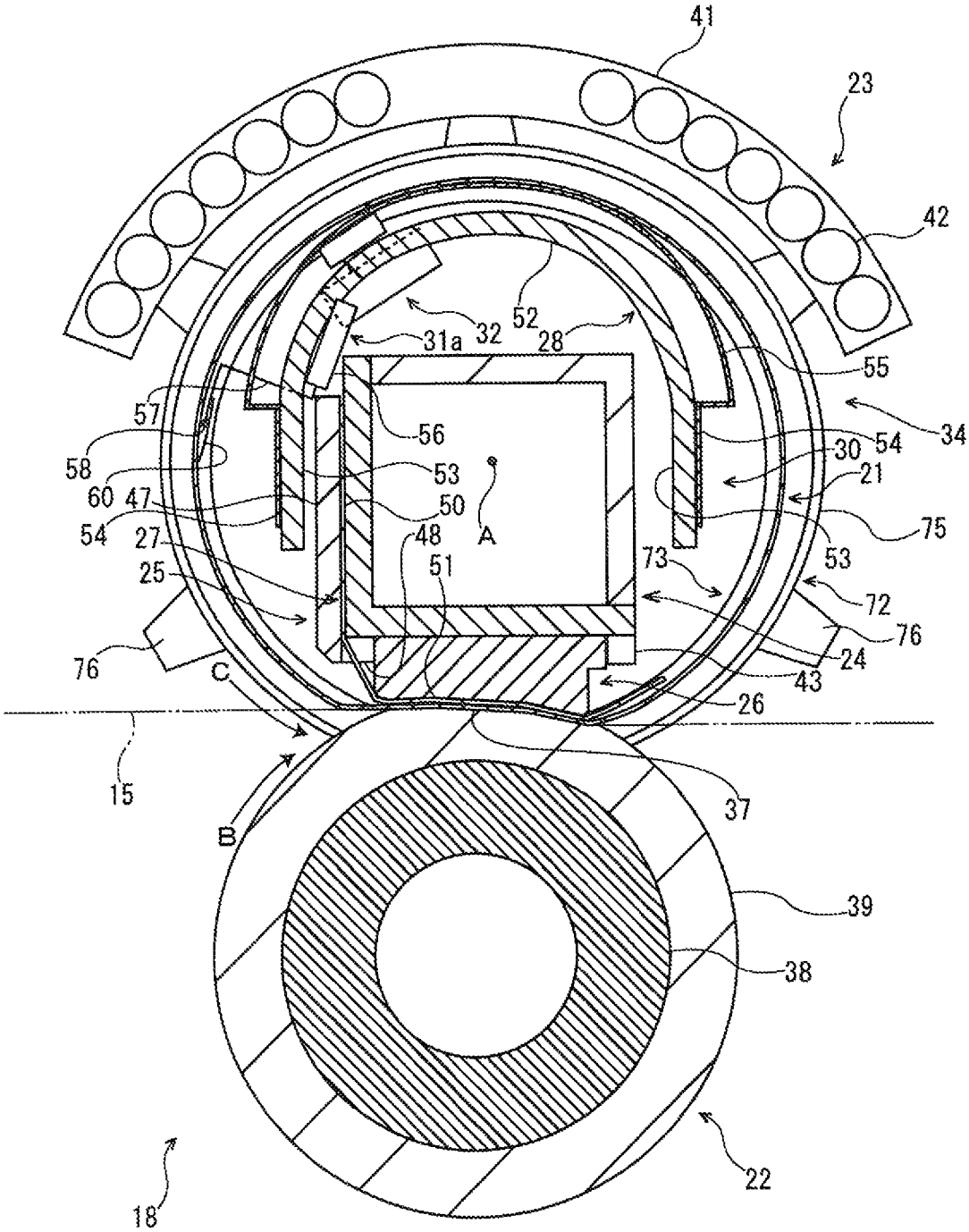
FIG. 2 is a sectional view showing a fixing device of the printer according to the embodiment of the present disclosure.
Figure 3:
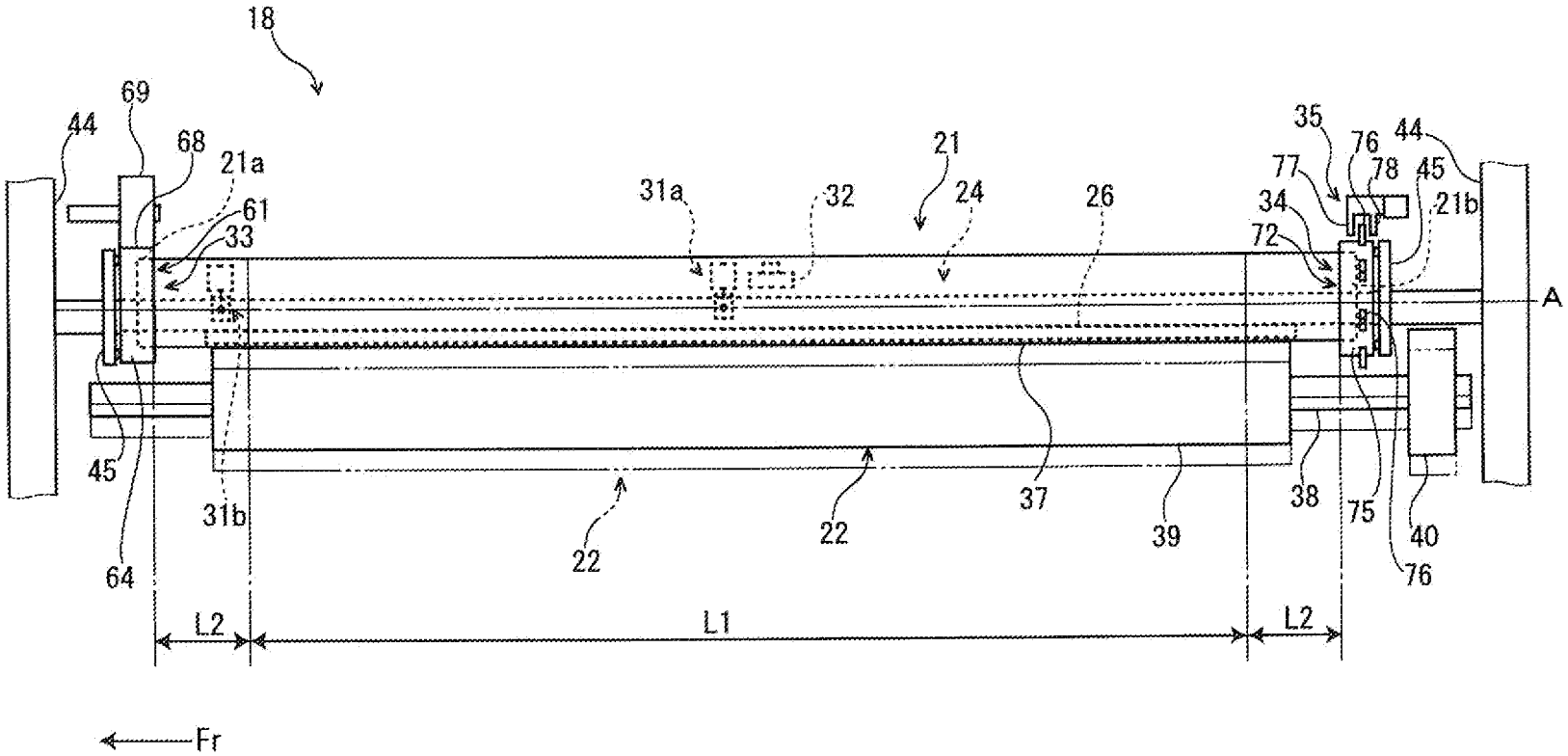
FIG. 3 is a side view showing the fixing device of the printer according to the embodiment of the present disclosure.

As shown in FIGS. 2 and 3, the fixing device 18 includes a fixing belt 21, a pressuring roller 22 (a pressuring rotation body), an IH (Induction Heating) fixing unit 23 (not shown in FIG. 3), a supporting member 24, a reinforcement member 25, a pressing pad 26 (a pressing member), a slide contacting member 27, a magnetism shielding member 28, a guide member 30, a pair of thermistors 31*a* and 31*b* (temperature detecting parts), a thermal insulating part 32 (a so-called thermo-cut), a drive transmission member 33, a detected member 34 and a rotation detecting part 35. The pressuring roller 22 is positioned below the fixing belt 21. The IH fixing unit 23 is positioned above the fixing belt 21. The supporting member 24 is positioned at an internal diameter side of the fixing belt 21. The reinforcement member 25 is positioned at the internal diameter side of the fixing belt 21 and at the left side of the supporting member 24. The pressing pad 26 is positioned at the internal diameter side of the fixing belt 21 and at the downward side of the supporting member 24. The slide contacting member 27 is positioned at the internal diameter side of the fixing belt 21 and from the left side to the downward side in the supporting member 24 and pressing pad 26. The magnetism shielding member 28 is positioned at the internal diameter side of the fixing belt 21 and at the upward side of the supporting member 24. The guide member 30 is positioned at the internal diameter side of the fixing belt 21 and at the upward side of the magnetism shielding member 28. The thermistors 31*a* and 31*b* are positioned at the internal diameter side of the fixing belt 21 and at the left side of the supporting member 24. The thermal insulating part 32 is positioned at the internal diameter side of the fixing belt 21 and at the left upward side of the supporting member 24. The drive transmission member 33 is held by a front end part 21*a* (one end part) of the fixing belt 21. The detected member 34 is held by a rear end part 21*b* (another end part) of the fixing belt 21. The rotation detecting part 35 is arranged above the detected member 34.

The fixing belt 21 is an endless thin belt having flexibility and is formed in a cylindrical shape elongated in the forward and backward directions. The fixing belt 21 is arranged to rotate around a rotation axis A extended in the forward and backward directions. That is, in the embodiment, a rotation axis direction of the fixing belt 21 is equal to the forward and backward directions.

The fixing belt 21 is composed of, for example, a base material layer and a release layer covering the base material layer. The base material layer of the fixing belt 21 is made of, for example, metal, such as nickel or stainless, or resin, such as polyimide (PI). The release layer of the fixing belt 21 is made of, for example, fluorine-based resin, such as perfluoro alkoxy alkane (PFA). The fixing belt 21 may have an elastic layer between the base material layer and release layer. The elastic layer is made of, for example, a silicone rubber.

The pressuring roller 22 is formed in a cylindrical shape elongated in the forward and backward directions. As shown in FIG. 2, the pressuring roller 22 comes into pressure contact with the fixing belt 21 and a fixing nip 37 is formed between the fixing belt 21 and pressuring roller 22. When the sheet is passed through the fixing nip 37, the sheet and toner image is heated and pressured, and then, the toner image is fixed to the sheet. The pressuring roller 22 is movable upward and downward between a position (refer to a solid line in FIG. 3) to come into pressure contact with the fixing belt 21 and another position (refer to a two-dot chain line in FIG. 3) to separate from the fixing belt 21. That is, the pressuring roller 22 is arranged contactably/separatably with respect to the fixing belt 21.

The pressuring roller 22 is rotatably supported by a fixing frame (not shown). The pressuring roller 22 is composed of, for example, a cylindrical cored bar 38, an elastic layer 39 provided around the cored bar 38 and a release layer (not shown) covering the elastic layer 39. The cored bar 38 of the pressuring roller 22 is made of, for example, metal, such as stainless or aluminum. To a rear end part of the cored bar 38 of the pressuring roller 22, a drive gear 40 (refer to FIG. 3) is fixed. The elastic layer 39 of the pressuring roller 22 is made of, for example, a silicone rubber or a silicone sponge. The release layer of the pressuring roller 22 is made of, for example, fluorine-based resin, such as PFA. The pressuring roller 22 is omitted in FIGS. 4 and 6.

As shown in FIG. 2, the IH fixing unit 23 includes a case member 41 and an IH coil 42 (a heat source) installed in the case member 41. The IH coil 42 is positioned at the external diameter side of the fixing belt 21 and arranged in an arc-like form along the outer circumference of the fixing belt 21.

The supporting member 24 is extended in the forward and backward directions to penetrate the fixing belt 21. The supporting member 24 is made, for example, by combining a pair of L-shaped metal plates and has a rectangular sectional shape. In a right lower corner part of the supporting member 24, a supporting protrusion 43 is provided to protrude to the downward side.

Figure 4:
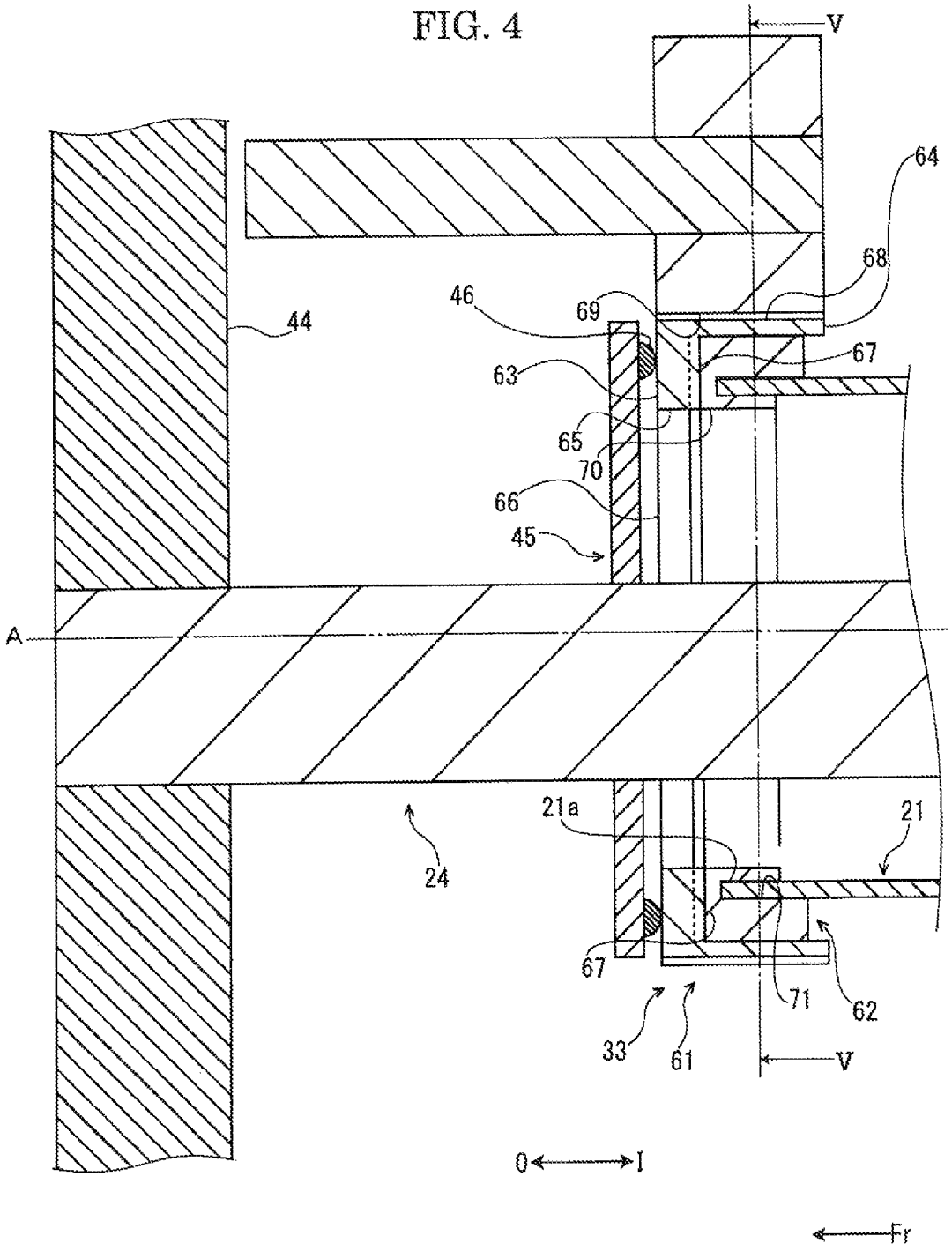
FIG. 4 is a side sectional view showing a front end part of a fixing belt and the periphery in the fixing device of the printer according to the embodiment of the present disclosure.
Figure 5:
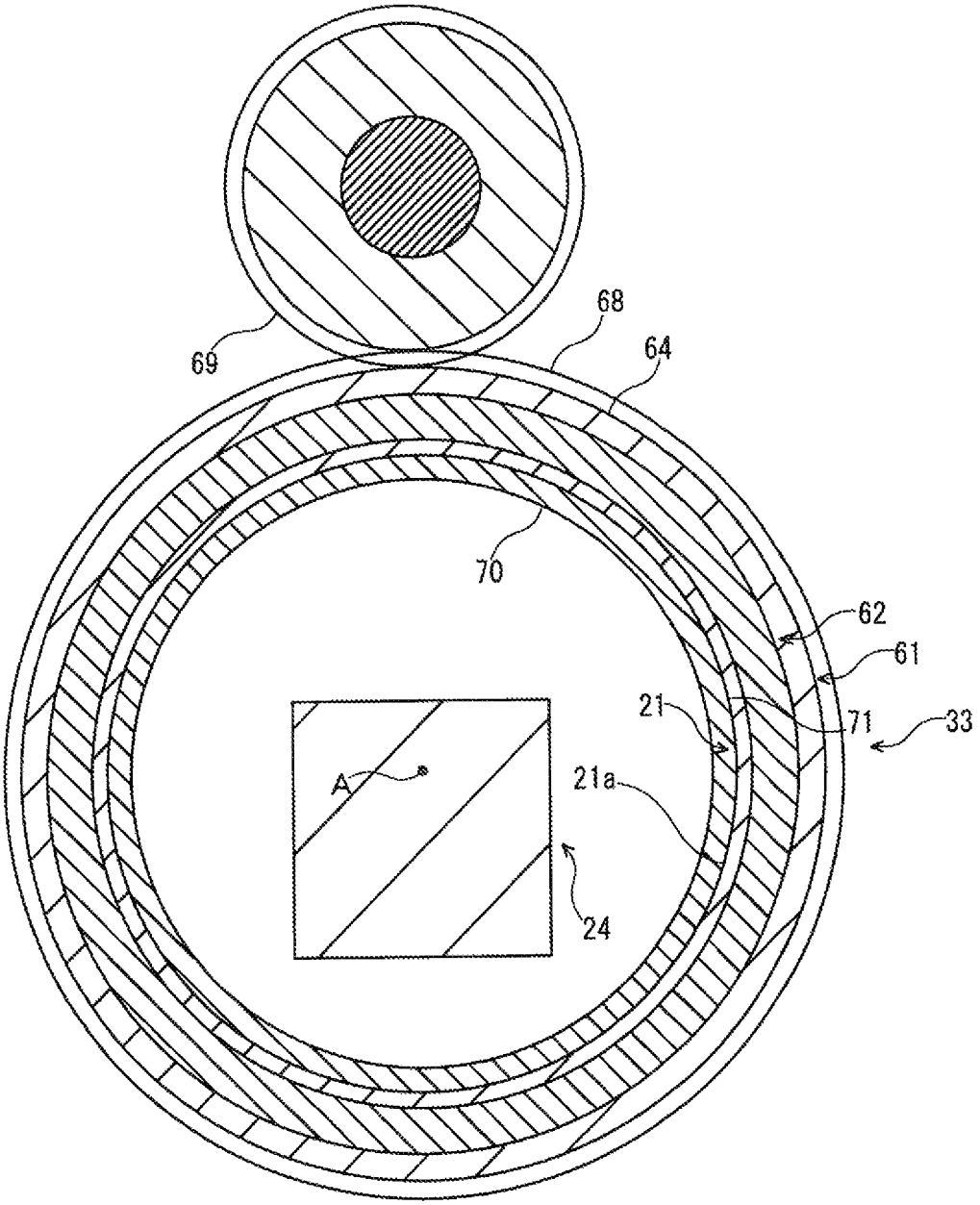
FIG. 5 is a sectional view taken along a line V-V of FIG. 4.
Figure 6:
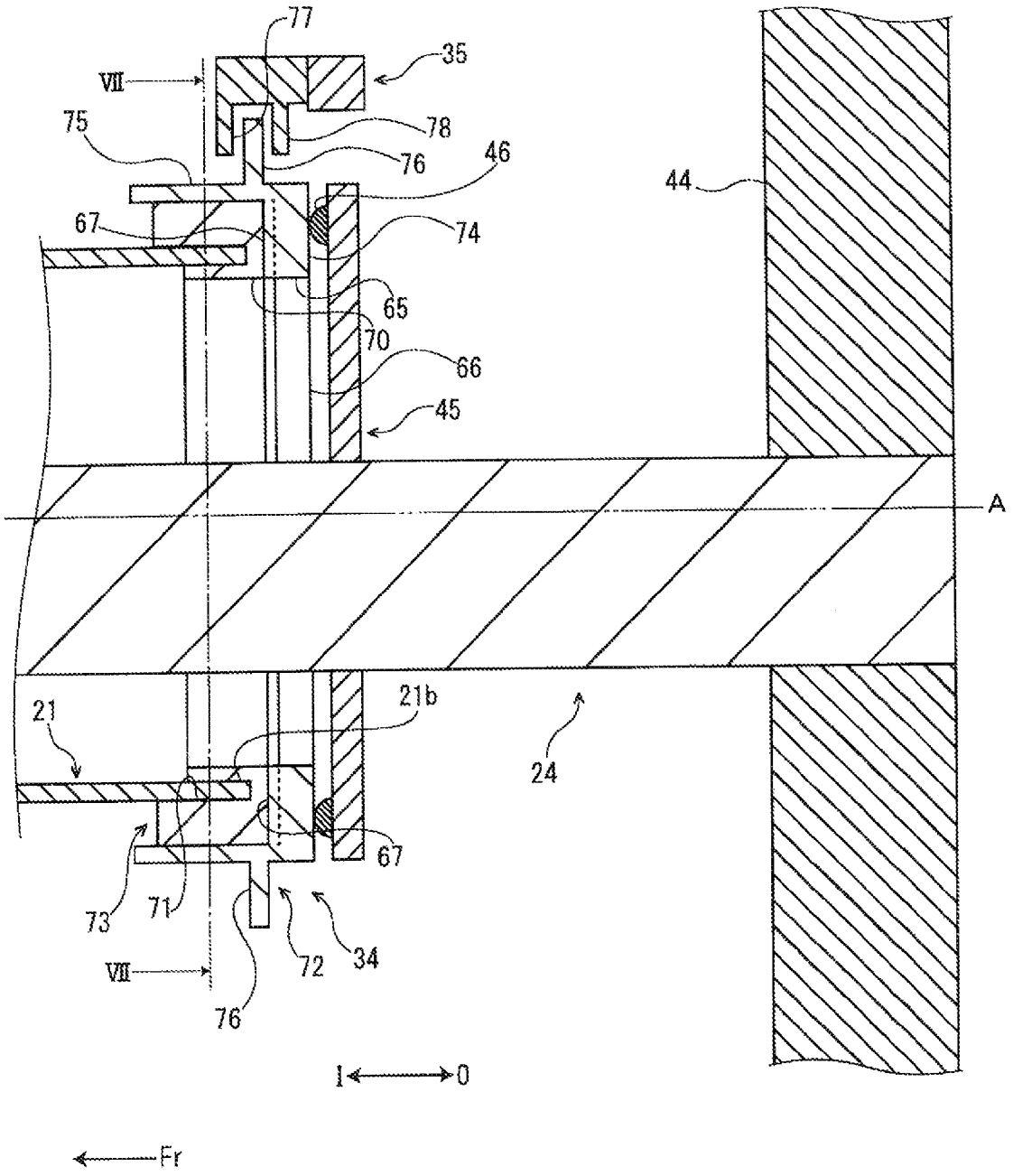
FIG. 6 is aside sectional view showing a rear end part of the fixing belt and the periphery in the fixing device of the printer according to the embodiment of the present disclosure.

As shown in FIG. 3, both end parts in the forward and backward directions of the supporting member 24 are fixed to fixing members 44 respectively arranged at the front side and rear side of the fixing belt 21. The fixing members 44 are, for example, fixed to a fixing frame (not shown) or constitute a part of the fixing frame. To both end parts in the forward and backward directions of the supporting member 24, ring-like formed bias stopping members 45 are fixed. The bias stopping members 45 are positioned at the internal side in the forward and backward directions from the respective fixing members 44. As shown in FIGS. 4 and 6 and other figures, in faces at the inside in the forward and backward directions of the bias stopping members 45, annular protruding parts 46 are respectively arranged.

As shown in FIG. 2, the reinforcement member 25 has a roughly L-shaped section and includes a first reinforcement part 47 extending in upward and downward directions and a second reinforcement part 48 bent from the lower end of the first reinforcement part 47 to the right side.

The pressing pad 26 is extended in the forward and backward directions. Atop face of the pressing pad 26 is fixed to a bottom face of the supporting member 24. Thereby, the pressing pad 26 is supported by the supporting member 24. A bottom face of the pressing pad 26 presses the fixing belt 21 from the internal diameter side to the downward side (to the side of the pressuring roller 22). The pressing pad 26 is inserted between the supporting protrusion 43 of the supporting member 24 and the second reinforcement part 48 of the reinforcement member 25.

The slide contacting member 27 has, for example, a sheet-like shape. The slide contacting member 27 includes a first contact part 50 extending in the upward and downward directions and a second contact part 51 bent from the lower end of the first contact part 50 to the right side. The first contact part 50 is inserted between a left side part of the supporting member 24 and the first reinforcement part 47 of the reinforcement member 25. The second contact part 51 is inserted between the bottom face of the pressing pad 26 and the fixing belt 21. When the fixing belt 21 is rotated, the fixing belt 21 slides with respect to the pressing pad 26 and second contact part 51. That is, the fixing device 18 of the embodiment is configured to apply a so-called "slide belt manner".

The magnetism shielding member 28 includes a curved plate part 52 curved in an arc-like form to the upward side and flat plate parts 53 extending from the both end parts in left and right directions of the curved plate part 52 to the downward side. The magnetism shielding member 28 is made of, for example, nonmagnetic material with excellent electric conductivity, such as oxygen free copper. The magnetism shielding member 28 prevent a magnetic field produced by the IH coil 42 from passing through the supporting member 24.

The guide member 30 is arranged so as to cover the upper side of the magnetism shielding member 28. The guide member 30 is made of, for example, a magnetic body. The guide member 30 has a function generating heat by the action of the magnetic field produced by the IH coil 42 to heat the fixing belt 21. The guide member 30 includes attachment parts 54 attached to the flat plate parts 53 of the magnetism shielding member 28 and a connection part 55 curved in an arc-like form to the upward side and connecting the attachment parts 54. The connection part 55 guides (strains) the fixing belt 21 from the internal diameter side.

As shown in FIG. 3, the thermistors 31*a* and 31*b* are arranged at intervals in the forward and backward directions. The thermistor 31*a* is arranged at the center of a sheet passing region L1 (a region where a maximum size of the sheet is passed) in the fixing belt 21 and the thermistor 31*b* is arranged at a non-sheet passing region L2 (a region where a maximum size of the sheet is not passed) in the fixing belt 21.

As shown in FIG. 2, each of the thermistors 31*a* and 31*b* (in FIG. 2, the thermistor 31*a* is shown) includes a housing 56 fixed to the curved plate part 52 of the magnetism shielding member 28, a plate spring 57 having an end part attached to the housing 56 and a terminal 58 fixed to another end part of the plate spring 57. The terminal 58 is pressured to an inner circumference face of the fixing belt 21 by given pressure of the plate spring 57. That is, in the thermistor 31*a* and 31*b* of the embodiment, a contact manner is applied. The terminal 58 is covered by a cover sheet 60.

The thermal insulating part 32 is fixed to the curved plate part 52 of the magnetism shielding member 28. The thermal insulating part 32 faces to the fixing belt 21 at an interval. As shown in FIG. 3, the thermal insulating part 32 is positioned at the center of the sheet passing region L1 of the fixing belt 21. The thermal insulating part 32 has a function stopping the production of the magnetic field from the IH coil 42 to prevent excessive temperature rise of the fixing belt 21 when the temperature of the sheet passing region L1 of the fixing belt 21 becomes a predetermined value or more.

As shown in FIG. 4, the drive transmission member 33 includes a first cap member 61 attached to the front end part 21*a* of the fixing belt 21 and a first elastic member 62 interposed between the front end part 21*a* of the fixing belt 21 and first cap member 61.

The first cap member 61 is made of, for example, heat resistant resin, such as liquid crystal polymer or polyphenylene sulfide (PPS). The first cap member 61 includes a first main body part 63 covering the outside in the forward and backward directions of the front end part 21*a* of the fixing belt 21 and a cylindrical first flange part 64 extending from an end part at the external diameter side of the first main body part 63 to the inside in the forward and backward directions and covering the external diameter side of the front end part 21*a* of the fixing belt 21.

The first main body part 63 of the first cap member 61 is arranged roughly perpendicular to the rotation axis A of the fixing belt 21. In the first main body part 63, a circular communication hole 65 is arranged in the forward and backward directions, and then, the supporting member 24 penetrates the communication hole 65. With a face 66 at the outside in the forward and backward directions of the first main body part 63, the protruding part 46 of the bias stopping member 45 comes into contact. Thereby, movement of the first cap member 61 to the outside in the forward and backward directions is restricted. In a face at the inside in the forward and backward directions of the first main body part 63, a plurality of ribs 67 are projected. The plurality of the ribs 67 are arranged radially around the rotation axis A of the fixing belt 21.

The first flange part 64 of the first cap member 61 is arranged in roughly parallel to the rotation axis A of the fixing belt 21. The first flange part 64 is arranged at an interval from an outer circumference face of the fixing belt 21. In an outer circumference part of the first main body part 63 and first flange part 64, a following gear 68 is arranged. The outer circumference part of the first main body part 63 and first flange part 64 correspond to the outer circumference part of the entire first cap member 61. The following gear 68 is meshed with an assistive drive gear 69 arranged above the first cap member 61 (refer to FIG. 5).

The first elastic member 62 is unglued to the fixing belt 21 and first cap member 61. The first elastic member 62 is made of, for example, a heat resistant rubber, such as a silicone rubber. In the first elastic member 62, a circular through hole 70 is formed in the forward and backward directions, and then, the supporting member 24 penetrates the through hole 70. In the first elastic member 62, an annular belt insertion part 71 is formed. The belt insertion part 71 is formed in a concave shape and opened to the inside in the forward and backward directions. Into the belt insertion part 71, the front end part 21*a* of the fixing belt 21 is inserted.

As shown in FIG. 6, the detected member 34 includes a second cap member 72 attached to the rear end part 21*b* of the fixing belt 21 and a second elastic member 73 interposed between the rear end part 21*b* of the fixing belt 21 and second cap member 72.

The second cap member 72 is made of, for example, heat resistant resin, such as liquid crystal polymer or polyphenylene sulfide (PPS). The second cap member 72 includes a second main body part 74 covering the outside in the forward and backward directions of the rear end part 21*b* of the fixing belt 21 and a cylindrical second flange part 75 extending from an end part at the external diameter side of the second main body part 74 to the inside in the forward and backward directions and covering the external diameter side of the rear end part 21*b* of the fixing belt 21.

A configuration of the second main body part 74 of the second cap member 72 is similar to a configuration of the first main body part 63 of the first cap member 61 of the drive transmission member 33. Therefore, the components of the second main body part 74 of the second cap member 72 are denoted by the same reference numerals as those of the first main body part 63 of the first cap member 61 of the drive transmission member 33 and their explanation is omitted.

Figure 7:
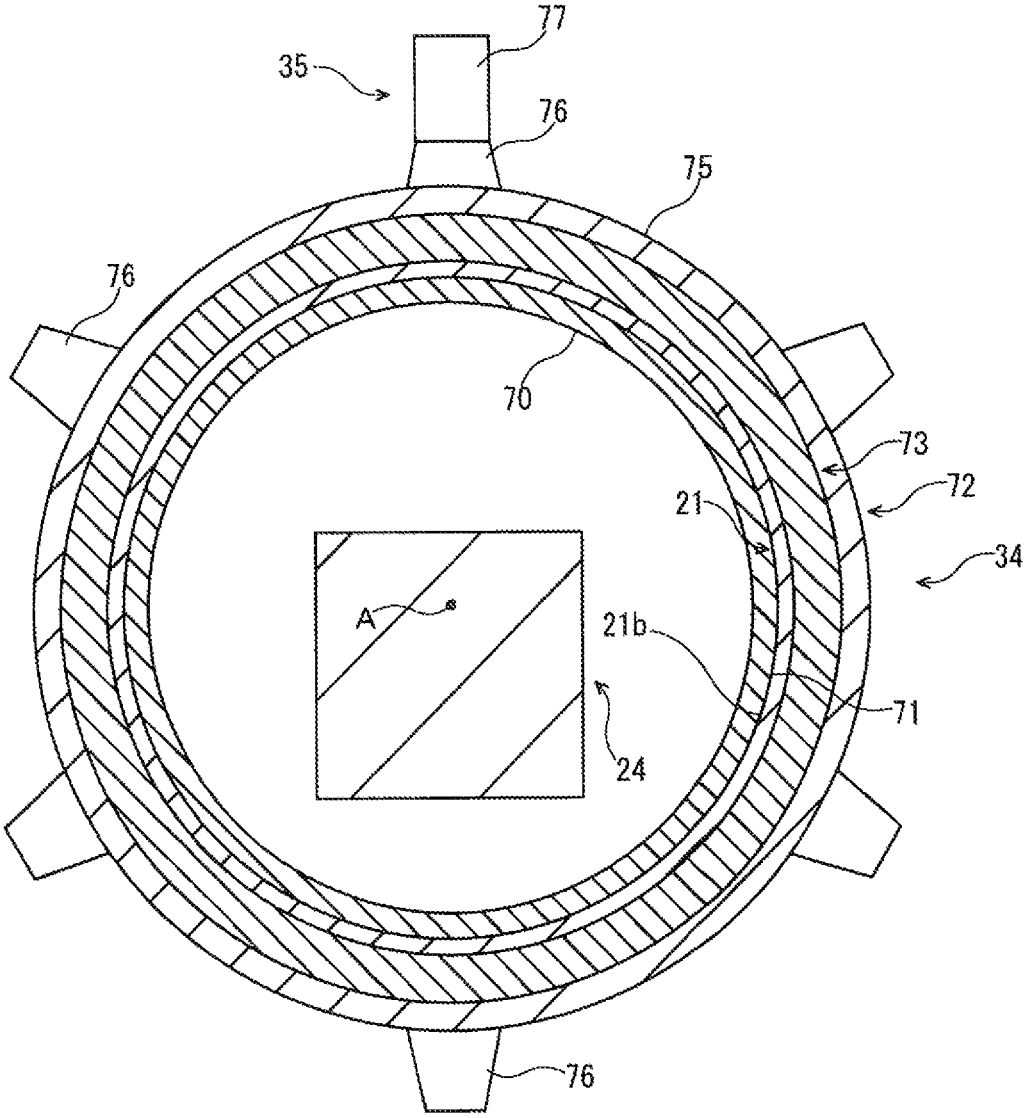
FIG. 7 is a sectional view taken along a line VII-VII of FIG. 6.

In the outer circumference part of the second flange part 75 of the second cap member 72, detected pieces 76 are protruded. The outer circumference part of the second flange part 75 corresponds to the outer circumference part of the entire second cap member 72. As shown in FIG. 7, a plurality of the detected pieces 76 (six detected pieces 76 in the embodiment) are arranged at equal angular intervals (at intervals of 60 degrees in the embodiment). Another configuration of the second flange part 75 of the second cap member 72 is similar to a configuration of the first flange part 64 of the first cap member 61 of the drive transmission member 33. Therefore, the components of the second flange part 75 of the second cap member 72 are denoted by the same reference numerals as those of the first flange part 64 of the first cap member 61 of the drive transmission member 33 and their explanation is omitted.

A configuration of the second elastic member 73 of the detected member 34 is similar to a configuration of the first elastic member 62 of the drive transmission member 33. Therefore, the components of the second elastic member 73 of the detected member 34 are denoted by the same reference numerals as those of the first elastic member 62 of the drive transmission member 33 and their explanation is omitted.

The rotation detecting part 35 is, for example, photo interrupter (PI) sensors. As shown in FIG. 6 and other figures, the rotation detecting part 35 includes a light emitting part 77 emitting light to the detected pieces 76 arranged in the second cap member 72 of the detected member 34 and a light receiving part 78 receiving the light from the light emitting part 77.

Next, a control system for the fixing device 18 will be described.

Figure 8:
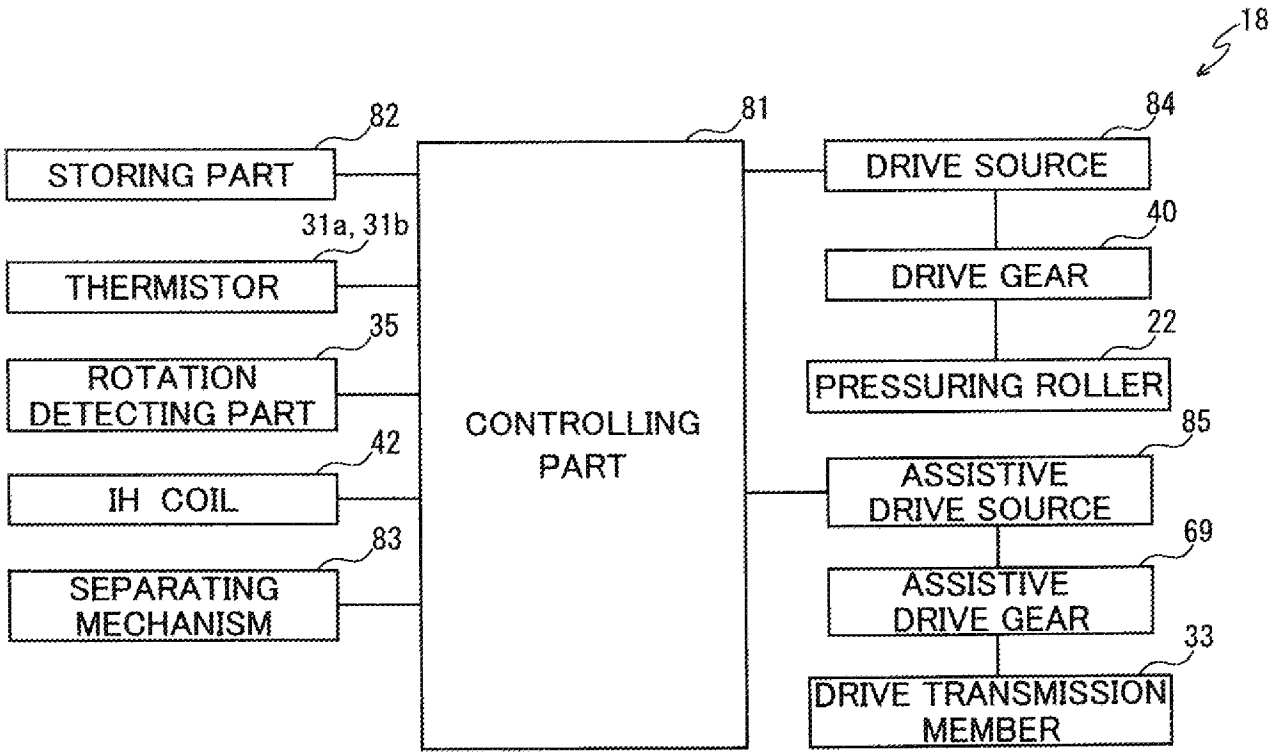
FIG. 8 is a block diagram showing a control system for the fixing device of the printer according to the embodiment of the present disclosure.

As shown in FIG. 8, in the fixing device 18, a controlling part 81 (CPU: Central Processing Unit) is installed. The controlling part 81 is connected to a storing part 82 composed of a storage device, such as a read only memory (ROM) or a random access memory (RAM). The fixing device 18 is configured so that the controlling part 81 controls components of the fixing device 18 on the basis of a control program or control data stored in the storing part 82.

The controlling part 81 is connected to the thermistors 31*a* and 31*b* so that the temperatures of the fixing belt 21 detected by the thermistors 31*a* and 31*b* are outputted to the controlling part 81.

The controlling part 81 is connected to the rotation detecting part 35 so that, when the rotation detecting part 35 detects the rotation of the detected member 34, detection signals are outputted to the controlling part 81.

The controlling part 81 is connected to the IH coil 42. When a current is flowed to the IH coil 42 on the basis of drive command from the controlling part 81, the IH coil 42 produces the magnetic field, the action of the magnetic field produces eddy current to the fixing belt 21, and then, the heat is generated to the fixing belt 21. That is, by the IH coil 42, the fixing belt 21 can be heated.

The controlling part 81 is connected to a separating mechanism 83. The separating mechanism 83 is connected to the pressuring roller 22. The separating mechanism 83 has a function moving the pressuring roller 22 upward and downward between the position to come into pressure contact with the fixing belt 21 and position to separate from the fixing belt 21.

The controlling part 81 is connected to a drive source 84 composed of a drive motor or the like and the drive source 84 is connected to the drive gear 40. When the drive source 84 rotates the drive gear 40, the pressuring roller 22 is rotated integrally with the drive gear 40. That is, by the drive source 84, the pressuring roller 22 can be rotated.

The controlling part 81 is connected to an assistive drive source 85 composed of a drive motor or the like and the assistive drive source 85 is connected to the assistive drive gear 69. When the assistive drive source 85 rotates the assistive drive gear 69, the drive transmission member 33 meshing the following gear 68 with the assistive drive gear 69 is rotated. That is, by the assistive drive source 85, the drive transmission member 33 can be rotated.

In a configuration as mentioned above, in order to fix the toner image on the sheet, the drive source 84 rotates the drive gear 40. According to this, the pressuring roller 22 is rotated integrally with the drive gear 40 (refer to an arrow B in FIG. 2) and the fixing belt 21 coming into pressure contact with the pressuring roller 22 is co-rotated with the rotation of the pressuring roller 22 (refer to an arrow C in FIG. 2).

At the same time that the drive source 84 rotates the drive gear 40 as mentioned above, the assistive drive source 85 rotates the assistive drive gear 69. When the assistive drive gear 69 is thus rotated, the drive transmission member 33 meshing the following gear 68 with the assistive drive gear 69 is rotated. According to this, by friction force between the front end part 21*a* of the fixing belt 21 and drive transmission member 33, the fixing belt 21 is co-rotated with the rotation of the drive transmission member 33. That is, the fixing belt 21 is co-rotated with the rotation of the drive transmission member 33 simultaneously with co-rotating with the rotation of the pressuring roller 22.

When the fixing belt 21 is thus rotated, by friction force between the rear end part 21*b* of the fixing belt 21 and the detected member 34, the detected member 34 is co-rotated with the rotation of the fixing belt 21. When the detected member 34 is thus rotated, an optical path from the light emitting part 77 to the light receiving part 78 is sequentially opened/closed by the detected piece 76 of the detected member 34, and then, the received light amounts of the light receiving part 78 is sequentially switched between the High level and Low level. Incidentally, if the fixing belt 21 is rotated, the supporting member 24, pressing pad 26 and slide contacting member 27 are kept in stopping states.

Moreover, in order to fix the toner image on the sheet, the current is flowed to the IH coil 42. According to this, the IH coil 42 produces the magnetic field, the action of the magnetic field produces eddy current to the fixing belt 21, and then, the heat is generated to the fixing belt 21. In such a situation, when the sheet is passed through the fixing nip 37, the sheet and toner image is heated and pressured, and then, the toner image is fixed on the sheet.

In the embodiment, as mentioned above, by the friction force between the front end part 21*a* of the fixing belt 21 and drive transmission member 33, the fixing belt 21 is co-rotated with the rotation of the drive transmission member 33, and moreover, by the friction force between the rear end part 21*b* of the fixing belt 21 and the detected member 34, the detected member 34 is co-rotated with the rotation of the fixing belt 21. By applying such a configuration, it is possible to co-rotate the fixing belt 21 with the rotation of the drive transmission member 33 without gluing and fixing the drive transmission member 33 to the front end part 21*a* of the fixing belt 21 and to co-rotate the detected member 34 with the rotation of the fixing belt 21 without gluing and fixing the detected member 34 to the rear end part 21*b* of the fixing belt 21. Therefore, both end parts 21*a* and 21*b* of the fixing belt 21 are easy to deform in a shape corresponding to the shape of the periphery part of the fixing nip 37. According to this, it is possible to reduce stress added to the fixing belt 21 and to prevent break of the fixing belt 21. In addition, since it is unnecessary to apply a special processing, such as a processing of a tooth-like shape, to the fixing belt 21, drive transmission member 33 and detected member 34, it is possible to simplify manufacturing process of the fixing device 18.

By transmitting the assistive drive from the drive transmission member 33 to the fixing belt 21, it is possible to securely rotate the fixing belt 21. By detecting the rotation of the detected member 34 co-rotating with the rotation of the fixing belt 21, it is possible to indirectly detect the rotation of the fixing belt 21. Thus, it is possible to cope with both secure rotation of the fixing belt 21 and detection of the rotation of the fixing belt 21.

When the drive transmission member 33 is rotated, the rotation is transmitted in order of the drive transmission member 33, fixing belt 21 and detected member 34. That is, if the fixing belt 21 is not rotated, the detected member 34 is not rotated. Therefore, it is possible to prevent a situation that the detected member 34 is rotated in spite of not rotating the fixing belt 21, and then, to prevent misdetection of the rotation detecting part 35.

The drive transmission member 33 includes the first elastic member 62 interposed between the front end part 21*a* of the fixing belt 21 and the first cap member 61. Therefore, it is possible to prevent the front end part 21*a* of the fixing belt 21 and first cap member 61 from being slidingly rubbed, and accordingly it is possible to prevent cracking of the front end part 21*a* of the fixing belt 21 and chipping of the first cap member 61. Furthermore, it is possible to improve the co-rotating ability of the first cap member 61 with respect to the fixing belt 21 by the first elastic member 62. In addition, since the first elastic member 62 is unglued to the fixing belt 21 and first cap member 61, it is easy to deform the first elastic member 62. The above-mentioned effects are achieved similarly in the second elastic member 73 of the detected member 34.

Since the first flange part 64 of the first cap member 61 of the drive transmission member 33 is arranged so as to cover the external diameter side of the front end part 21*a* of the fixing belt 21, the deformation of the fixing belt 21 to the internal diameter side is not restricted by the presence of the first flange part 64 of the first cap member 61, and then, it is possible to sufficiently secure a deformation amount of the fixing belt 21 to the internal diameter side. According to this, it is possible to respond to a case where great deformation of the fixing belt 21 to the internal diameter side is desired, i.e., a case where widening of width of the fixing nip 37 is desired. The above-mentioned effects are achieved similarly in the second flange part 75 of the second cap member 72 of the detected member 34.

With the face 66 at the outside in the forward and backward directions of the first main body part 63 of the first cap member 61 and the face 66 at the outside in the forward and backward directions of the second main body part 74 of the second cap member 72, the protruding parts 46 of the respective bias stopping members 45 come into contact. By applying such a configuration, it is possible to securely restrict the bias to one side in the forward and backward directions of the fixing belt 21.

The fixing device 18 is configured to apply a so-called "slide belt manner" and to include the pressing pad 26 pressing the fixing belt 21 to the downward side (to the side of the pressuring roller 22) and the supporting member 24 supporting the pressing pad 26. Therefore, it is possible to reduce heat capacity of the fixing device 18 and to swiftly rise temperature of the fixing belt 21.

Next, a method of detecting the break of the fixing belt 21 will be described.

First, by the separating mechanism 83, the pressuring roller 22 is separated from the fixing belt 21. In such a situation, by the assistive drive source 85, the assistive drive gear 69 is rotated. When the assistive drive gear 69 is thus rotated, the drive transmission member 33 meshing the following gear 68 with the assistive drive gear 69 is rotated. When the drive transmission member 33 is thus rotated, by the friction force between the front end part 21*a* of the fixing belt 21 and drive transmission member 33, the fixing belt 21 is co-rotated with the rotation of the drive transmission member 33.

Ina case where the fixing belt 21 is normal, for example, in a case where the fixing belt 21 is not broken, when the fixing belt 21 is rotated as mentioned above, by the friction force between the rear end part 21*b* of the fixing belt 21 and the detected member 34, the detected member 34 is co-rotated with the rotation of the fixing belt 21. Therefore, the rotation of the detected member 34 is detected by the rotation detecting part 35. In such a case, the controlling part 81 decides that the fixing belt 21 is normal.

On the other hand, in a case where the fixing belt 21 is abnormal, for example, in a case where the fixing belt 21 is partly broken, even if the front end part 21*a* of the fixing belt 21 is rotated, since the transmission of the rotation is cut off due to the broken part of the fixing belt 21, the rear end part 21*b* of the fixing belt 21 is not rotated. Therefore, the detected member 34 is not rotated, and accordingly the rotation detecting part 35 does not detect the rotation of the detected member 34 within a predetermined time. In such a case, the controlling part 81 decides that the fixing belt 21 is abnormal.

In the embodiment, a case where both drive transmission member 33 and detected member 34 include the cap members and elastic members was described. However, in another embodiment, anyone of the drive transmission member 33 and detected member 34 may include the cap member and elastic member. In such a case, another of the drive transmission member 33 and detected member 34 may include, for example, the cap member.

In the embodiment, the drive source 84 rotating the pressuring roller 22 and assistive drive source 85 rotating the drive transmission member 33 are individually arranged. However, in another embodiment, the drive source 84 rotating the pressuring roller 22 may be used to rotate the drive transmission member 33.

In the embodiment, a case where the detected pieces 76 are arranged in the second cap member 72 of the detected member 34 was described. However, in another embodiment, the detected pieces 76 may be arranged in the second elastic member 73 of the detected member 34.

In the embodiment, a case of applying the configuration of the present disclosure to the fixing device 18 having the so-called "slide belt manner" was described. However, in another embodiment, the configuration of the present disclosure may be applied to the fixing device 18 having another manner rotating the fixing belt 21 together with one or more rollers arranged at the internal diameter side of the fixing belt 21.

In the embodiment, a case of using the IH coil 42 as the heat source was described. However, in another embodiment, another heater, such as a halogen heater or a ceramic heater, may be used as the heat source.

The embodiment was described in a case of applying the configuration of the present disclosure to the printer 1. On the other hand, in another embodiment, the configuration of the disclosure may be applied to another image forming apparatus, such as a copying machine, a facsimile or a multifunction peripheral.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A fixing device comprising:

a fixing belt rotating around a rotation axis;

a pressuring rotation body coming into pressure contact with the fixing belt to form a fixing nip;

a drive transmission member held by one end part of the fixing belt;

a detected member held by another end part of the fixing belt;

a rotation detecting part detecting the rotation of the detected member;

a controlling part connected to the rotation detecting part;

a drive source rotating the pressuring rotation body; and an assistive drive source composed of a drive motor and rotating the drive transmission member;

wherein the fixing belt is configured to co-rotate with the rotation of the drive transmission member by friction force between the one end part of the fixing belt and drive transmission member, the detected member is configured to co-rotate with the rotation of the fixing belt by friction force between the other end part of the fixing belt and detected member, the pressuring rotation body is arranged contactably/separatably with respect to the fixing belt, the controlling part is configured to detect that the fixing belt is abnormal when the rotation detecting part does not detect the rotation of the detected member in a predetermined time if the assistive drive source rotates the drive transmission member in a situation the pressuring rotation body is separated from the fixing belt, wherein the drive transmission member includes:

a first cap member attached to the one end part of the fixing belt; and a first elastic member interposed between the one end part of the fixing belt and first cap member, wherein the first cap member includes:

a first main body part covering outside in the rotation axis direction of the one end part of the fixing belt; and a first flange part extending from the first main body part to the inside in the rotation axis direction and covering the external diameter side of the one end part of the fixing belt.

2. The fixing device according to claim 1 further comprising:

bias stopping members coming into contact with faces at outside in the rotation axis direction of the drive transmission member and detected member.

3. The fixing device according to claim 2, wherein a protruding part is arranged in a face at the inside in the rotation axis direction of the bias stopping member.

4. The fixing device according to claim 1 further comprising:

a pressing member pressing the fixing belt to the side of the pressuring rotation body; and a supporting member supporting the pressing member.

5. A fixing device comprising:

a fixing belt rotating around a rotation axis;

a pressuring rotation body coming into pressure contact with the fixing belt to form a fixing nip;

a drive transmission member held by one end part of the fixing belt;

a detected member held by another end part of the fixing belt;

a rotation detecting part detecting the rotation of the detected member;

a controlling part connected to the rotation detecting part;

a drive source rotating the pressuring rotation body; and an assistive drive source composed of a drive motor and rotating the drive transmission member;

wherein the fixing belt is configured to co-rotate with the rotation of the drive transmission member by friction force between the one end part of the fixing belt and drive transmission member, the detected member is configured to co-rotate with the rotation of the fixing belt by friction force between the other end part of the fixing belt and detected member, the pressuring rotation body is arranged contactably/separatably with respect to the fixing belt, the controlling part is configured to detect that the fixing belt is abnormal when the rotation detecting part does not detect the rotation of the detected member in a predetermined time if the assistive drive source rotates the drive transmission member in a situation the pressuring rotation body is separated from the fixing belt, wherein the detected member includes:

a second cap member attached to the other end part of the fixing belt; and a second elastic member interposed between the other end part of the fixing belt and second cap member, wherein the second cap member includes:

a second main body part covering outside in the rotation axis direction of the other end part of the fixing belt; and a second flange part extending from the second main body part to the inside in the rotation axis direction and covering the external diameter side of the other end part of the fixing belt.

6. An image forming apparatus comprising:

a fixing device, wherein the fixing device includes:

a fixing belt rotating around a rotation axis;

a pressuring rotation body coming into pressure contact with the fixing belt to form a fixing nip;

a drive transmission member held by one end part of the fixing belt;

a detected member held by another end part of the fixing belt;

a rotation detecting part detecting the rotation of the detected member;

a controlling part connected to the rotation detecting part;

a drive source rotating the pressuring rotation body; and an assistive drive source composed of a drive motor and rotating the drive transmission member;

wherein the fixing belt is configured to co-rotate with the rotation of the drive transmission member by friction force between the one end part of the fixing belt and drive transmission member, the detected member is configured to co-rotate with the rotation of the fixing belt by friction force between the other end part of the fixing belt and detected member, the pressuring rotation body is arranged contactably/separatably with respect to the fixing belt, the controlling part is configured to detect that the fixing belt is abnormal when the rotation detecting part does not detect the rotation of the detected member in a predetermined time if the assistive drive source rotates the drive transmission member in a situation the pressuring rotation body is separated from the fixing belt, wherein the drive transmission member includes:

a first cap member attached to the one end part of the fixing belt; and a first elastic member interposed between the one end part of the fixing belt and first cap member, wherein the first cap member includes:

a first main body part covering outside in the rotation axis direction of the one end part of the fixing belt; and a first flange part extending from the first main body part to the inside in the rotation axis direction and covering the external diameter side of the one end part of the fixing belt.

7. The image forming apparatus according to claim 6, wherein the fixing device includes:

bias stopping members coming into contact with faces at outside in the rotation axis direction of the drive transmission member and detected member.

8. The image forming apparatus according to claim 7, wherein a protruding part is arranged in a face at the inside in the rotation axis direction of the bias stopping member.

9. The image forming apparatus according to claim 6, wherein the fixing device includes:

a pressing member pressing the fixing belt to the side of the pressuring rotation body; and a supporting member supporting the pressing member.

10. An image forming apparatus comprising:

a fixing device, wherein the fixing device includes:

a fixing belt rotating around a rotation axis;

a pressuring rotation body coming into pressure contact with the fixing belt to form a fixing nip;

a drive transmission member held by one end part of the fixing belt;

a detected member held by another end part of the fixing belt;

a rotation detecting part detecting the rotation of the detected member;

a controlling part connected to the rotation detecting part;

a drive source rotating the pressuring rotation body; and an assistive drive source composed of a drive motor and rotating the drive transmission member;

wherein the fixing belt is configured to co-rotate with the rotation of the drive transmission member by friction force between the one end part of the fixing belt and drive transmission member, the detected member is configured to co-rotate with the rotation of the fixing belt by friction force between the other end part of the fixing belt and detected member, the pressuring rotation body is arranged contactably/separatably with respect to the fixing belt, the controlling part is configured to detect that the fixing belt is abnormal when the rotation detecting part does not detect the rotation of the detected member in a predetermined time if the assistive drive source rotates the drive transmission member in a situation the pressuring rotation body is separated from the fixing belt, wherein the detected member includes:

a second cap member attached to the other end part of the fixing belt; and a second elastic member interposed between the other end part of the fixing belt and second cap member, wherein the second cap member includes:

a second main body part covering outside in the rotation axis direction of the other end part of the fixing belt; and a second flange part extending from the second main body part to the inside in the rotation axis direction and covering the external diameter side of the other end part of the fixing belt.

* * * * *